US007137238B2

(12) United States Patent
Maccabruni et al.

(10) Patent No.: US 7,137,238 B2
(45) Date of Patent: Nov. 21, 2006

(54) YARN QUALITY ASSURANCE METHOD AND YARN PROCESSING MACHINE

(75) Inventors: Davide Maccabruni, Zürich (CH); Robin Gutbrod, Meilen (CH)

(73) Assignee: Schärer Schweiter Mettler AG, Horgen (CH)

( * ) Notice: Subject to any disclaimer, the term of this patent is extended or adjusted under 35 U.S.C. 154(b) by 0 days.

(21) Appl. No.: 11/209,965

(22) Filed: Aug. 23, 2005

(65) Prior Publication Data

US 2006/0042220 A1 Mar. 2, 2006

(30) Foreign Application Priority Data

Aug. 26, 2004 (EP) ..... 04020215

(51) Int. Cl.
*D01H 13/26* (2006.01)

(52) U.S. Cl. ..... 57/264; 57/265

(58) Field of Classification Search ..... 57/9, 57/264, 265, 333
See application file for complete search history.

(56) References Cited

U.S. PATENT DOCUMENTS 3,983,608 A 10/1976 Stanley
4,122,588 A 10/1978 Borenstein et al.
5,221,059 A 6/1993 Coons, III et al.
6,199,361 B1 * 3/2001 Yakushi et al. ..... 57/332

FOREIGN PATENT DOCUMENTS

CH 691 386 A5 7/2001
DE 43 00 633 A1 7/1993

* cited by examiner

*Primary Examiner*—Shaun R. Hurley
(74) *Attorney, Agent, or Firm*—Walter A. Hackler

(57) ABSTRACT

A yarn quality assurance method and a yarn processing machine set up for implementing the method according to the invention is proposed comprising at least one feeding spool receiver 24, 30 set up to receive respectively at least one feeding spool 20, 29 from which yarns can be taken off, and a multifilament yarn manufacturing unit 5 to which yarns are supplied from the feeding spools 20, 29 via thread runs with respectively one thread tension. According to the invention, a thread tension regulating module 25 with a thread tension sensor is arranged in at least one controlled thread run 1 between the relevant feeding spool receiver 24 and the multifilament yarn manufacturing unit 5, wherein the thread tension regulating module 25 is set up to derive a control value from a thread tension measured by the thread tension sensor and to keep the thread tension constant in a predetermined thread tension range.

7 Claims, 2 Drawing Sheets

YARN QUALITY ASSURANCE METHOD AND YARN PROCESSING MACHINE

BACKGROUND OF THE INVENTION

The invention relates to a yarn quality assurance method when manufacturing a multifilament yarn and a yarn processing machine for implementing the yarn quality assurance method. The yarn quality assurance method comprises the process steps of taking off at least one thread from respectively one feeding spool and supplying the yarn via a run of thread into a multifilament yarn manufacturing unit, wherein the yarns are held at a thread tension. The yarn quality assurance method is suitable in principle for use in any multifilament yarn manufacturing method e.g., in draw-winding or weaving, but especially for use in texturing methods, especially false twist texturing methods and/or air covering methods.

Machines with an air-covering nozzle (air-covering machine) are used to process filament yarns together permanently to form a multi-component yarn (air-covering yarn) by means of an air jet (interlacing jet). In this case, at least one covering thread (fancy yarn) is joined to a core thread as components. The aim of this process is to achieve joining knots in the multi-component yarn which are as uniform as possible and thus join the components together whereby the multifilament yarn produced has good mechanical and structural elasticity. An example of an air-covering yarn is disclosed in U.S. Pat. No. 6,405,519 B1. The core thread generally comprises an elastomer-containing highly elastic yarn, e.g. Lycra®. The covering threads can comprise various fancy yarns. The yarns, that is the covering threads and the core thread are supplied via feeder rolls e.g. godet rolls, to an air-covering nozzle. After the multi-component yarn has passed through the air-covering nozzle, the multi-component yarn is taken up by a spool onto which said multi-component yarn is wound.

In this case, the elastic yarn is unwound from a feeding spool positively and tangentially, with the aid of special feeder rolls (tangential take-off). In order to execute this operation, at least one additional drive is required. In order to tangentially unwind the feeding spool of the elastic yarn, said spool is positioned with its axis parallel to the axes of the feeder rolls used for the unwinding. When the feeding spool is empty, the complete manufacturing process must be stopped so that the feeding spool can be replaced. In order to interrupt the production process only as briefly as possible when the feeding spool needs to be changed, e.g., when the current feeding spool is used up, complex systems have been developed for changing the feeding spool automatically. Such a system is disclosed for example in WO 2004/035446. For tangential take-off a distinction is made between two variants. In free-running tangential take-off the feeding spool sits on a freely rotating tube without is own drive. Freely-rotating take-off can only be used at low process speeds. In driven tangential take-off the rotation of the feeding spool is driven via supporting rollers. This driven tangential take-off can be used for high production speeds with elastic yarns.

The covering threads can be produced, for example using a known yarn processing machine for processing filament yarns with an air-texturing nozzle (air-texturing machine). The manufacture of the covering threads and the processing. e.g. using an air-texturing nozzle, is usually carried out by a single machine. Such an air-texturing machine is disclosed in DE 39 09 516 A1. Air-texturing machines are used to permanently crimp smooth structureless filament yarns. In this case, a plurality of feed yarns (core threads) can be processed with fancy yarns of different tradition to form a textured yarn. In this process the filament yarns are uniformly crimped and if necessary arranged around the feed yarns. The covering threads can comprise various fancy threads. The filament yarns, that is the covering threads and the core threads, are supplied to an air-texturing nozzle via feeder rolls, e.g. godet rolls. After the yarns have passed through the air-texturing nozzle, the product fancy yarn consisting of a plurality of components (multi-component yarn) is taken off from a spool onto which the multi-component yarn is wound. Before the spooling the multi-component yarn can be stretched again, fixed, shrunk and/or finished.

It is further known to manufacture the covering threads using a yarn processing machine for implementing the false twist texturing method. This method is known as torsion crimping. In this case, the filament yarn is given a so-called false twist by a false twist spindle between two pairs of cylinders, namely feeder rolls and take-off rollers, and this false twist is fixed in its capillary threads by heating the filament yarn using its thermoplastic properties. After cooling the latent torsional forces have an effect and result in crimping of the product fancy yarn.

For this purpose, the multifilament yarn (thread) is generally unwound from a spool, passed through first feeder rolls, then heated in a heater (primary heater), cooled on a cooling rail, passed through a false twist spindle and second feeder rolls arranged thereafter, and so-called take-off feeder rolls before being finally wound onto a yarn spool. The false twist spindle is used to highly twist the multifilament yarn temporarily in one working process, i.e., to produce a twist of the multifilament yarn or the individual filament yarns by transferring an axial torque to the filament yarns. This temporary twist (torque state) is designated as false twist (FD). As a result of the twisting, a rotation back pressure is formed which extends back into the heater (twist zone) whereby it is possible for the torque state of the filament yarn to be thermally fixed by heating and cooling before the false twist spindle. After the false twist spindle, the twisting is then released again. As a result of the thermal fixing accomplished in the torque state, the yarn has the desired crimped structure.

Very high production speeds can be achieved by using a friction false twist spindle as the false twist spindle. In these false twist spindles the filament yarn is indirectly driven using friction surfaces. As a result of the smaller diameter of the thread compared to the spindle, i.e., to a disk of a disk friction unit, for example, a high transmission ratio is achieved between the revolution of the disk and the twisting of the filament yarn. A triaxial disk friction unit is especially suitable for this purpose. Thus, predominantly friction false twist spindles, especially triaxial disk friction units and also so-called nip twisters which transfer a torque to the filament yarns by means of crossed belts are used as false twist spindles. Such a disk friction unit is disclosed in DE 3743708 A1 for example. A nip twister is disclosed in JP 06184848. The imparting of twist by means of friction makes it possible to achieve very high rotation speeds and therefore also high production speeds. If the friction relationships between the filament yarns and the false twist spindle vary, that is if process fluctuations or instabilities occur, this then results in a non-uniform yarn structure or defects in the yarn and thus in loss of quality in the yarn produced. Such defects or disturbances can, for example, result from disturbances in the spinning mill, from non-uniform application or non-uniform adjustment of the spinning preparation on the thread surface, from temperature fluctuations during texturing or from contamination e.g. in the heater and/or in the cooling rail. The disturbances can bring about a so-called ballooning of the yarn which occurs particularly at high rotation speeds and the high thread tensions associated therewith. Ballooning of the yarn results in an uncontrolled run of thread and fluctuations in the thread tension. As a result, the thread can, for example, jump over the disk surface of the false twist spindle. This twist slippage leads to a twist deficit inside the twist zone, i.e., the twist density, that is the number of twists per unit length of filament yarn fluctuates. The thread to be processed can thus pass in sections through the false twist spindle without twisting. This results in short closed yarn sections, so-called "tight spots" and long non-uniformly textured yarn sections which is called surging. During surging the thread tension increases abruptly whereby the equilibrium of forces in the false twist spindle is destroyed. Zones are formed in the thread without twist. In addition, the stretching values fluctuate and the dyeing is unsatisfactory.

Texturing speeds of over 300 m/min can be achieved with friction false twist spindles. The lengths of the heating and cooling zones in the texturing zone are adapted to these texturing speeds in order to ensure sufficient thermal fixing of the crimping. If the total length of the texturing zone is 5–6 m, the phenomenon of surging occurs particularly frequently in conjunction with the friction false twist spindles which operate by force locking. In force-locking false twist spindles according to the prior art, the twist density produced cannot be controlled very exactly, and this results in process-technology production limitation of the surging and therefore ballooning of the thread in the twist zone with associated thread tension fluctuations which in turn results in twist fluctuations. The stability limit of the process is influenced on the one hand by the geometry of the texturing zone, e.g., its length, deflection points, thread support etc. and on the other hand by the quality of the feed material, e.g., its uniformity, preparation etc. that is by process fluctuations which occur.

Another factor which limits the production speed in false twist texturing processes is the unwinding speed of the yarns, e.g. a partially oriented multifilament yarn (POY), from the feeding spool. Higher unwinding speeds result in stronger variations of the yarn tension (thread tension) in the area of the run of thread after the feeding spool (unwinding region). This follows from the properties of the known "balloon" formed by the yarn during unwinding.

A false twist texturing process always with unwinding a POY yarn from a feeding spool. The yarn is taken off from the feeding spool by the rotating movement of a take-off roll (feeder rolls). The take-off roll usually comprises a main roll driven by a motor and a passive separating roll which defines the defines the geometry of windings of the yarn around the main roll. In order to avoid variations of thread tension in the unwinding region, it is known to exert a pressing force on the main roll by means of a nip roller, that is another roller. The yarn is thereby clamped between the main roller and the further roller, with the result that the yarn is supplied to the texturing process at the tangential speed of the main roller. Various pre-tensioning systems arranged between the feeding spool and the feeder rolls are further known to increase and stabilise the thread tension of the yarn during take-off from the feeding spool.

The variations of the thread tension, e.g. of the POY yarn taken off from the feeding spool, essentially have the following causes:

Since the diameter of the feeding spool decreases with time as a result of the unwinding of the thread, the geometry of the "balloon" formed by the yarn movements along the spool axis varies accordingly which influences the thread tension.

As a result of increasing the production speed and thus the unwinding speed of the yarn from the feeding spool, centrifugal forces acting on the yarn in the "balloon" increase, which increases the thread tension. These problems appear particularly severely especially with polyamide (PA) yarns.

In the known devices for avoiding fluctuations of thread tension during texturing processes, the thread tension of the yarn can only be regulated before the start of the manufacturing process. This is not sufficient to avoid the variations of the thread tension during the manufacturing process which have been described.

The document CH 691 386 A discloses a device and a method for texturing a running thread. The tension of the thread entering into a texturing nozzle is detected and the twisting effect in the texturing nozzle is accordingly controlled.

It is further known from EP 0 875 479 A1 to measure and regulate the thread tension of individual yarns during yarn conditioning methods associated with winding processes, e.g., oiling, dyeing or stretching of yarns. In this case, the thread tension of a yarn is measured in its thread run after a conditioning device and the thread tension of the controlled yarn is kept constant before its spooling, that is at the end of the conditioning process, in a predetermined range of thread tension by means of a thread tension regulating module according to a control value derived from the measured thread tension. The thread tension regulating module comprises a brake and a controllable feeder roll by which means the thread tension is regulated by braking and/or accelerating the thread speed of the yarn.

It is the object of the invention to provide a yarn quality assurance method which avoids the disadvantages of the prior art and in particular, makes it possible to achieve a high process speed with minimal downtimes of the yarn processing machine.

SUMMARY OF THE INVENTION

This object is solved by the yarn quality assurance method and the yarn processing machine of the independent claims. The dependent claims present preferred embodiments of the invention.

The yarn quality assurance method according to the invention for the manufacture of a multifilament yarn comprises the following process steps:

unwinding at least one thread from respectively one feeding spool and supplying the threads over respectively one thread run into a multifilament yarn manufacturing unit wherein the yarns are held at a thread tension.

According to the invention, at least the thread tension of a controlled thread is measured in its thread run between its feeding spool and the multifilament yarn manufacturing unit and before being supplied into the multifilament yarn manufacturing unit, the thread tension of the controlled yarn is kept constant in a predetermined thread tension range by means of a thread tension regulating module according to a control value derived from the measured thread tension.

The thread tension regulating module can, for example, be constructed in accordance with the device disclosed in EP 0 875 479 A1. The important thing is that the thread tension regulating module has an active adjustable drive with the possibility for regulating the thread tension. The thread tension can be measured, for example, using a thread tension sensor comprising a strain gauge. However, it also possible to measure and monitor the electrical power consumption of the drive. Since the friction values between the yarn and the drive are influenced by the thread tension, the electrical power consumption of the drive varies depending on the thread tension from which the control value can be determined. A standard feeder roll combined with any type of thread tension regulating system, e.g. a measuring device which measures the electric current flowing through the feeder rolls together with a circuit to evaluate the measured current can thus be used as the thread tension regulating system. The feeder rolls themselves act as a thread tension tensor in this arrangement.

With the method according to the invention, the thread tension in the unwinding region is stabilised so that a regular thread tension profile is maintained over time regardless of the process speed and the diameter of the feeding spool. This ensures a uniform quality of the product multifilament yarn, e.g. the textured yarn over the entire length of the POY yarn, for example, on the feeding spool. Further, an increase in the production speed of the manufacturing process is achieved for the same yarn quality.

The method according to the invention makes it possible to achieve complete "online" control of the thread tension during unwinding of the yarn from the feeding spool. The thread tension can be kept constant regardless of the quality of the yarn, the diameter of the feeding spool, and the selected unwinding speed. In addition to the possibility of increasing or reducing the thread tension during winding in a controlled fashion if necessary, the thread tension can be permanently reduced whereby a higher production speed and efficiency can be achieved.

The controlled yarn is especially advantageously supplied by means of the multifilament yarn manufacturing unit, preferably via feeder rolls first to a heater, thereafter to a cooler and thereafter to an air texturing nozzle or preferably to a twisting unit. The method according to the invention is thus used in false twist texturing. When the method according to the invention is used in false-twist texturing processes the "surging" which typically occurs at high production speeds is largely avoided.

The method according to the invention is especially preferably used with a highly elastic yarn as a controlled yarn, wherein the highly elastic yarn is supplied, preferably via feeder rolls and/or at least one thread guiding device to an air covering nozzle of the multifilament yarn manufacturing unit. In this case, the highly elastic yarn is unwound overhead.

The method according to the invention allows the elastic yarn to be taken off overhead since the fluctuations in thread tension which occur are compensated. If the elastic yarn is taken off overhead in an air-covering process, interruptions of the production process caused by changing the feeding spool can be avoided. During overhead take-off the feeding spool itself does not rotate so that during overhead take-off it is possible to work with a reserve feeding spool which can be used immediately so that downtimes of a suitably operating yarn processing machine can be minimised. The reserve feeding spool is positioned symmetrically to the vertical axis of the yarn processing machine with the feeding spool from which the elastic yarn is currently being taken off. The free end of the yarn on the reserve feeding spool is knotted with the terminating end of the yarn on the feeding spool currently being unwound. When the yarn on the feeding spool currently being unwound is used up, the yarn of the reserve feeding spool is automatically taken off and the manufacturing process continues without interruption. The empty feeding spool is then replaced by a new feeding spool which is used as the new reserve feeding spool where the yarn of the new feeding spool is accordingly knotted with that of the old reserve feeding spool. An almost continuous process is thereby achieved.

The thread speed of the controlled yarn is preferably braked and/or accelerated by means of the thread tension regulating module. The thread tension can be increased and reduced by braking or accelerating the thread speed. If the measured thread tension is recorded, the quality of the product multifilament yarn can be subsequently assessed and checked.

A yarn processing machine according to the invention has at least one feeding spool receiver set up to receive respectively at least one feeding spool from which yarns can be taken off and a multifilament yarn manufacturing unit to which yarns can be supplied from the feeding spools via thread runs with respectively one thread tension. According to the invention, a thread tension regulating module comprising a thread tension sensor is arranged in at least one controlled thread run between the relevant feeding spool receiver and the multifilament yarn manufacturing unit, wherein the thread tension regulating module preferably comprises a thread brake and/or controllable feeder rolls. The thread tension regulating module is set up to derive a control value from a thread tension measured by a thread tension sensor and keep the thread tension constant in a predetermined thread tension range. The yarn quality assurance method according to the invention can be implemented using the yarn processing machine according to the invention. The yarn processing machine according to the invention thus provides the advantages of the yarn quality assurance method according to the invention.

In the yarn processing machine according to the invention, the multifilament yarn manufacturing unit comprises, arranged one after the other in the thread run, preferably feeder rolls, a heater and a cooler arranged thereafter and an air texturing nozzle arranged thereafter or preferably a false twist spindle. In this arrangement the yarn processing machine is a texturing machine, that is a false twist texturing machine or an air texturing machine wherein production errors caused by fluctuations of thread tension are largely eliminated.

The multifilament yarn manufacturing unit preferably comprises an air-covering nozzle wherein preferably feeder rolls and/or at least one thread guiding device are provided in the thread run before the air-covering nozzle and wherein a feeding spool receiver is set up in the controlled thread run to take off overhead a highly elastic yarn from a feeding spool taken up by the feeding spool receiver. The feeder rolls can be part of the thread tension regulating module. The thread guiding device makes it possible to always supply the highly elastic yarn from the same position from the thread tension regulating module. This is especially advantageous during overhead unwinding of the elastic yarn from the feeding spool since interruption of the manufacturing process by changing the feeding spool can be avoided during overhead unwinding by means of a reserve feeding spool, where the reserve feeding spool can be held ready in another feeding spool receiver.

The invention is explained in detail subsequently using exemplary embodiments with reference to the drawings.

DESCRIPTION OF THE PREFERRED EMBODIMENT

Figure 1:
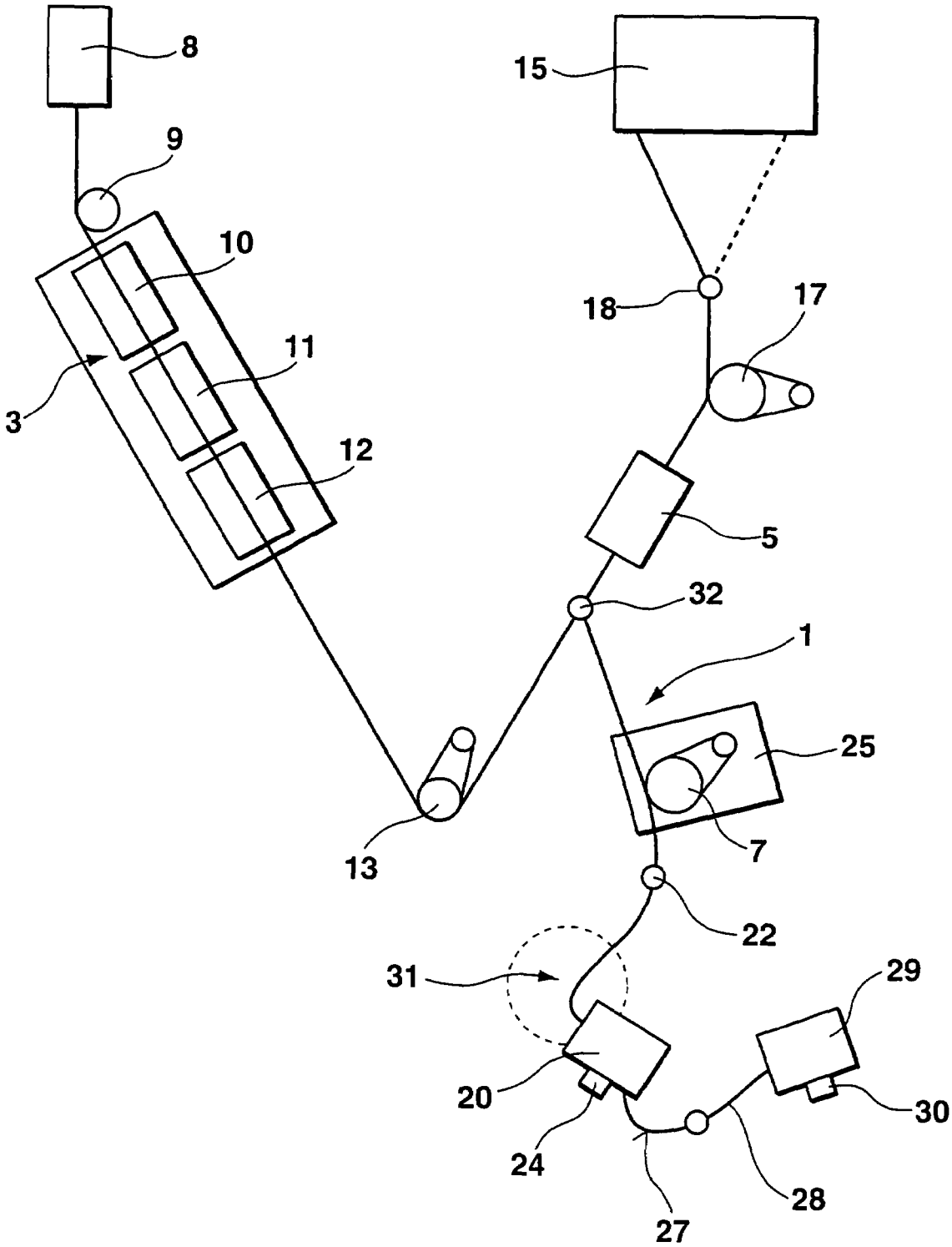
FIG. 1 shows the thread run in a yarn processing machine according to the invention.

The figures in the drawings show the subject matter of the invention highly schematically and should be understood as not being to scale. The individual components of the subject matter according to the invention are represented so that their structure can be clearly shown.

FIG. 1 shows a controlled thread run 1 in a yarn processing machine according to the invention by which means an air-covering method is executed using an elastic yarn and a yarn produced in a false twist texturing unit 3 as covering thread. The method according to the invention is shown for the example of a yarn processing machine which produces a covering thread for air-covering by means of false twist texturing. The method according to the invention and especially the preferred embodiment of the supply of an elastic yarn as controlled yarn to an air-covering unit 5 as a multifilament yarn manufacturing unit via actively driven feeder rolls 7 and the overhead unwinding of the elastic yarn used in this case can equally well be used, for example, in conjunction with the manufacture of an air-textured yarn. The figure shows a possible arrangement of elements which can be included in a combination of a false twist texturing process with an air-covering process. At the end of the texturing unit where the yarn for texturing, which is unwound from a feeding spool 8 via feeder rolls 9, has passed through a heater 10, a cooler 11 and a twisting unit 12, the textured yarn is guided around feeder rolls 13 before it enters into the air-covering nozzle 5 where it is joined to the elastic yarn i.e., where the textured yarn is joined to the elastic yarn by means of small knots to form a compact structure for the subsequent method, that is essentially winding the finished multifilament yarn onto a spool 15. Before it is wound onto the spool 15, the finished multifilament yarn is guided via feeder rolls 17 arranged between the air-covering nozzle 5 and the spool 15 and a thread guiding device 18. The elastic yarn is taken off overhead from the feeding spool 20. In this case, the elastic yarn is initially guided through the thread guiding device 22 and then via the actively driven feeder rolls 7. These feeder rolls 7 are part of a thread tension regulating module 25. This comprises an active adjustable drive set up to control and regulate the thread tension. The feeder rolls 7 pull on the elastic yarn as a result of their drive whereby the elastic yarn is taken off from the feeding spool 20 overhead. A stretching of the elastic yarn required to achieve mechanical stability of the product multifilament yarn is adjusted via the difference between the rotation speed of the delivery rolls 17 arranged between the air-covering nozzle 5 and the spool 15 and the actively driven feeder rolls 7. During overhead take-off it is possible to unroll the yarn from outside or from inside the feeding spool 20. The feeding spool 20 is always fixedly received by a feeding spool receiver 24. Since the feeding spool 20 does not rotate during overhead take-off, one end 27 of the yarn of the feeding spool 20 can be joined to a beginning 28 of a yarn of another feeding spool (reserve feeding spool 29) held in a feeding spool receiver 30 whereby the reserve feeding spool 29 is automatically unwound after unwinding of the first feeding spool 20 has been completely unwound. Thus, the manufacturing process need not be interrupted during overhead take-off.

Overhead take-off from outside is particularly suitable for the method according to the invention since particularly high speeds can be achieved during unwinding of the yarn in this case. During overhead take-off a "balloon" 31 forms whereby the thread tension varies substantially in the unwinding region. In order that these variations in thread tension do not negatively influence the quality of the multifilament yarn to be manufactured, in the yarn processing machine shown the thread tension is regulated by means of the thread tension regulating module 25 between the feeding spool receiver 24 and the air-covering nozzle 5 and is kept constant within a thread tension range. In the example shown the thread tension regulating module 25 is arranged between two thread guiding devices 22, 32 where one is arranged directly in front of the air-covering nozzle 5. In this thread guiding device 32 the elastic yarn is combined with false-twist-textured covering thread, for example and then supplied to the air-covering nozzle 5 with a regulated thread tension. The thread guiding device 22 before the thread tension regulating module 25 is arranged in a central position before the actively driven feeder rolls 7. This thread guiding device 22 has the effect that the elastic yarn is always fed into the actively driven feeder rolls 7 from the same position regardless of which feeding spool 20, 29 is used. For this purpose the thread guiding device 22 lies "at the focus" of the two feeding spools 20, 29.

Figure 2:
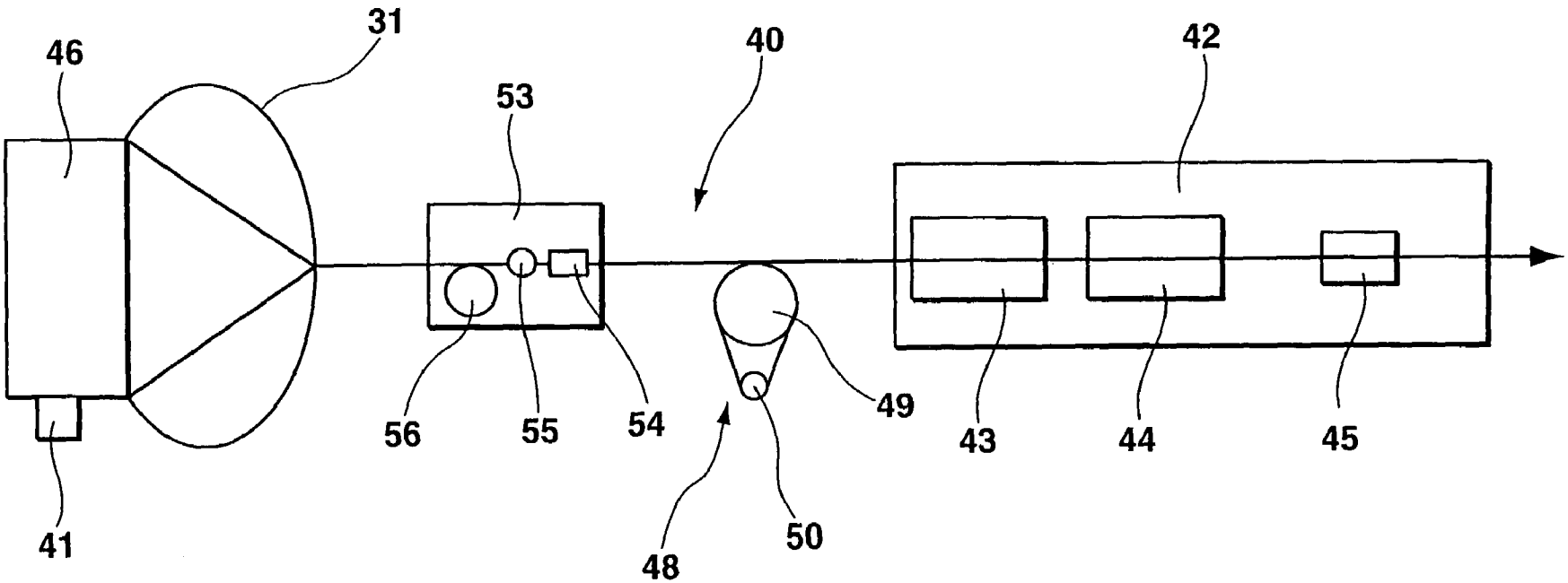
FIG. 2 shows a thread run between the feeding spool receiver and the multifilament yarn manufacturing unit used to implement the false twist texturing method.

FIG. 2 shows a controlled thread run 40 in a yarn processing machine according to the invention between a feeding spool receiver 41 and a multifilament yarn manufacturing unit embodied as a false twist texturing unit 42. The false twist texturing unit 42 has a heater 43, a cooler 44 and a twisting unit 45. From a feeding spool 46 located in the feeding spool receiver 41 the yarn is supplied via feeder rolls 48 to the false twist texturing unit 42. The feeder rolls 48 have a main roll 49 and a separating roll 50 around which the yarn is wound. As a result of the unwinding process the yarn forms a "balloon" 31. A thread tension regulating module 53 is arranged in the run of thread between the balloon 31 and the feeder rolls 48. The thread tension regulating module 53 comprises a thread tension sensor 54 which measures the thread tension, a thread brake 55 and controllable feeder rolls 56. A control value of the thread tension is derived by means of the thread tension regulating module 53, by which means the thread tension is kept constant in a predetermined range. This control value can, for example, be a difference between the measured thread tension and a desired thread tension. The thread brake 55 and/or the controllable feeder rolls 56 are controlled according to the control value. If the measured thread tension is too high, for example, the speed of the yarn is braked by means of the thread brake 55. Using the yarn processing machine according to the invention, the thread tension which increasing linearly with increasing process speed in the prior art can be kept at constant value regardless of the process speed. The thread tension can thus be adjusted according to the needs of the manufacturing process ("downstream process") of the multifilament yarn. The thread tension is measured using the thread tension sensor 54 and the rotation speed of the controllable feeder rolls 56 and/or the braking power of the thread brake 55 is controlled in a closed control loop according to the measured thread tension. If the diameter of the feeding spool 46 decreases, the thread tension is automatically adapted by the thread tension regulating module 53 via the control loop so that it corresponds to a desired value during the entire production process, i.e., is kept constant within a predetermined range of thread tension. The thread tension regulating module 53 thus regulates the thread tension with which, for example, the POY yarn is supplied to a multifilament yarn manufacturing unit e.g. a false twist texturing unit 42 at a predetermined value which is independent of any increase in the process speed, whereby one of the factors limiting any increase in the process speed during false twist texturing is eliminated.

A yarn quality assurance method and a yarn processing machine set up for implementing the method according to the invention is proposed comprising at least one feeding spool receiver 24, 30 set up to receive respectively at least one feeding spool 20, 29 from which yarns can be taken off, and a multifilament yarn manufacturing unit 5 to which yarns are supplied from the feeding spools 20, 29 via thread runs with respectively one thread tension. According to the invention, a thread tension regulating module 25 with a thread tension sensor is arranged in at least one controlled thread run 1 between the relevant feeding spool receiver 24 and the multifilament yarn manufacturing unit 5, wherein the thread tension regulating module 25 is set up to derive a control value from a thread tension measured by the thread tension sensor and to keep the thread tension constant in a predetermined thread tension range.

The invention is not restricted to the exemplary embodiments specified previously. Rather it is possible to have a number of variants which make use of the features of the invention in a fundamentally different type of design.

We claim:

1. A yarn quality assurance method for the manufacture of a multifilament yarn comprising:

taking off at least one thread from respectively one feeding spool;

supplying the thread over respectively one thread run into a multifilament yarn manufacturing unit wherein threads are held at a thread tension;

measuring at least the thread tension of a controlled thread in its thread run between another feeding spool and the multifilament yarn manufacturing unit; and keeping the thread tension of the controlled thread constant in a predetermined thread tension range by means of a thread tension regulating module according to a control value derived from the measured thread tension before being supplied to the multifilament yarn manufacturing unit.

2. The yarn quality assurance method according to claim 1, wherein by means of the multifilament yarn manufacturing unit the controlled yarn is supplied, via feeder rolls first to a heater, thereafter to a cooler and thereafter to an air texturing nozzle or a twisting unit.

3. The yarn quality assurance method according to claim 1, wherein as a controlled yarn, a highly elastic yarn is supplied, preferably via feeder rolls and/or at least one thread guiding device to an air covering nozzle of the multifilament yarn manufacturing unit, wherein the highly elastic yarn is taken off overhead.

4. The yarn quality assurance method according to claim 1, wherein a thread speed of the controlled yarn is braked and/or accelerated by means of the thread tension regulating module and/or the measured thread tension is recorded.

5. A yarn processing machine for the manufacture of a multifilament yarn, the machine comprising:

a feeding spool receiver from which threads can be taken off;

another feeding spool from which a controlled thread can be taken off;

a multifilament yarn manufacturing unit to which yarns can be supplied from the feeding spools via thread runs with respective thread tensions; and a thread tension regulating module comprising a thread tension sensor arranged in at least one controlled thread run between a relevant feeding spool receiver and a multifilament yarn manufacturing unit, the thread tension regulating module comprising a thread brake and/or controllable feeder rolls and the thread tension regulating module is set up to derive a control value from a thread tension measured by a thread tension sensor and keep the thread tension constant in a predetermined thread tension range.

6. The yarn processing machine according to claim 5, wherein the multifilament yarn manufacturing unit comprises, arranged one after the other in the thread run, feeder rolls, a heater and a cooler arranged thereafter and an air texturing nozzle or a false twist spindle arranged thereafter.

7. The yarn processing machine according to claim 5, wherein the multifilament yarn manufacturing unit has an air-covering nozzle wherein feeder rolls and/or at least one thread guiding device are provided in the thread run before the air-covering nozzle and wherein a feeding spool receiver is set up in the controlled thread run to take off overhead a highly elastic yarn from a feeding spool taken up by the feeding spool receiver.

* * * * *